US005971260A

United States Patent [19]

Mertens

[11] Patent Number: 5,971,260

[45] Date of Patent: Oct. 26, 1999

[54] CONTINUOUS STRIP OF DETACHABLY INTERCONNECTED FOLDED PRODUCTS

[76] Inventor: Luc Mertens, Leopoldlaan 162, B-9300 Aalst, Belgium

[21] Appl. No.: 08/913,051

[22] PCT Filed: Mar. 6, 1996

[86] PCT No.: PCT/BE96/00023

§ 371 Date: Sep. 5, 1997

§ 102(e) Date: Sep. 5, 1997

[87] PCT Pub. No.: WO96/27531

PCT Pub. Date: Sep. 12, 1996

[30] Foreign Application Priority Data

Mar. 6, 1995 [BE] Belgium ..... 9500194

[51] Int. Cl.[6] ..... B65D 27/10

[52] U.S. Cl. ..... 229/69

[58] Field of Search ..... 229/69

[56] References Cited

U.S. PATENT DOCUMENTS

| | | | |
|---|---|---|---|
| 2,464,490 | 3/1949 | Davies | 229/69 |
| 2,610,784 | 9/1952 | Henry | 229/69 |
| 2,776,085 | 11/1957 | Furey | 229/69 |
| 3,028,069 | 4/1962 | Willis | 229/69 |
| 3,332,604 | 7/1967 | Whitman | 229/69 |
| 3,559,875 | 2/1971 | Wilson | 229/69 |
| 3,626,821 | 12/1971 | Gendron | 229/69 X |
| 3,790,068 | 2/1974 | Stutz | 229/69 |
| 4,066,206 | 1/1978 | Peterson . | |
| 4,497,509 | 2/1985 | Gore . | |
| 4,804,135 | 2/1989 | Bourbeau | 229/69 |
| 4,886,205 | 12/1989 | Schnitzer . | |
| 4,896,821 | 1/1990 | Bell | 229/69 |
| 5,069,384 | 12/1991 | Bell | 229/69 |

FOREIGN PATENT DOCUMENTS

| | | | |
|---|---|---|---|
| 0 226 990 | 7/1987 | European Pat. Off. . | |
| 1 488 888 | 7/1967 | France . | |
| 567924 | 1/1946 | United Kingdom . | |
| 2145032 | 3/1985 | United Kingdom | 229/69 |

*Primary Examiner*—Jes F. Pascua
*Attorney, Agent, or Firm*—Browdy and Neimark

[57] ABSTRACT

The invention relates to a continuous strip of detachable consecutive interconnected products manufactured by folding, such as envelopes and the like, and to a process for manufacturing the said strip, two of those consecutive products being interconnected through a joint (22) which is not part of the products themselves and links up detachably, through successive lines of demarcation, with each of those two consecutive products in such a way that, on removing this joint (22), the said two consecutive products are entirely separated.

4 Claims, 6 Drawing Sheets

CONTINUOUS STRIP OF DETACHABLY INTERCONNECTED FOLDED PRODUCTS

BACKGROUND OF THE INVENTION

1. Technical Field of the Invention

This invention relates to a continuous strip of detachable consecutive interconnected products, obtained through folding, notably envelopes, bags, files, cases, foldable packing material, etc.

2. Prior Art

Continuous strips of detachable envelopes have long been used, as is shown a.o. by the following patent specifications: U.S. Pat. No. 4,066,206 (Peterson), FR-A-1,488,888 (Gysin) and GB-A-567,925 (Davies).

Such strips of envelopes, however, hold various disadvantages as to the appearance and the finish of the envelopes, after they have been separated. The said envelopes, for instance, clearly show marks of division lines.

OBJECT AND SUMMARY OF THE INVENTION

The invention inter alia aims at remedying those flaws in a very simple and effective way and at offering a continous strip of detachable interconnected products, the visible edges of which, for instance, when they are separated, are completely finished in such a way that, as far as finishing and aspect is concerned, they entirely correspond to the ones which are manufactured separately one by one and that they are hardly distinguishable from them, and this, in spite of the envelopes originally being made from a continous strip, in a somewhat analogous way to the first application set forth in patent GB-A-567925.

To that end, according to the invention, two consecutive products in the continuous strip are interconnected by a joint not being part of the products themselves and being connected, in a detachable way, through successive lines of demarcation, to each of those two consecutive products, in such a way that, on removing the joint, the said two consecutive products are completely severed.

Functionally, at least part of the joints linking the consecutive products are attached to a common carrier in such a way that, together with the carrier, they may be severed from the other products through one single operation.

In a particular application of the continuous strip of consecutive products, a joint, according to this invention, if relevant products are being formed from longitudinally consecutive areas of material which are interconnected at least through a folding line transverse to that direction, extends from the free edge of a so-called end area of a product of that strip to a so-called initial area of material of the consecutive product of the strip.

In a specific application of this invention, if those products consist of envelopes with three successive areas of material constituting, respectively, the closing flap, the front portion and the back portion of an envelope, the closing flap forms the said initial area and the back portion the said end area.

According to a preferred application of the invention, the joints stretch out beyond the products, in such a way that it is possible to print those joints in a similar way to and together with the products which are interconnected through the latter.

The invention also pertains to a process for manufacturing a continuous strip of products produced through folding, consecutive series of areas of material being constituted, which—are separated by folding lines transverse to the longitudinal direction of that strip, and two adjacent series of such areas of material being interconnected by division lines through a joint, a product out of every series of areas of material being constituted by joining the said areas through folding them round the said folding lines.

BRIEF DESCRIPTION OF THE DRAWINGS

Other particulars and advantages from the invention will be shown in the following description of some specific applications of the strip according to the invention and a process to manufacture them; this description is only provided by way of an example and does not restrict the scope of the protection claimed; the numbers referred to hereafter pertain to the corresponding drawings.

DETAILED DESCRIPTION OF THE PREFERRED EMBODIMENT(S) OF THE INVENTION

In the various drawings, the same numbers refer to the same or to analogous elements.

Figure 1:
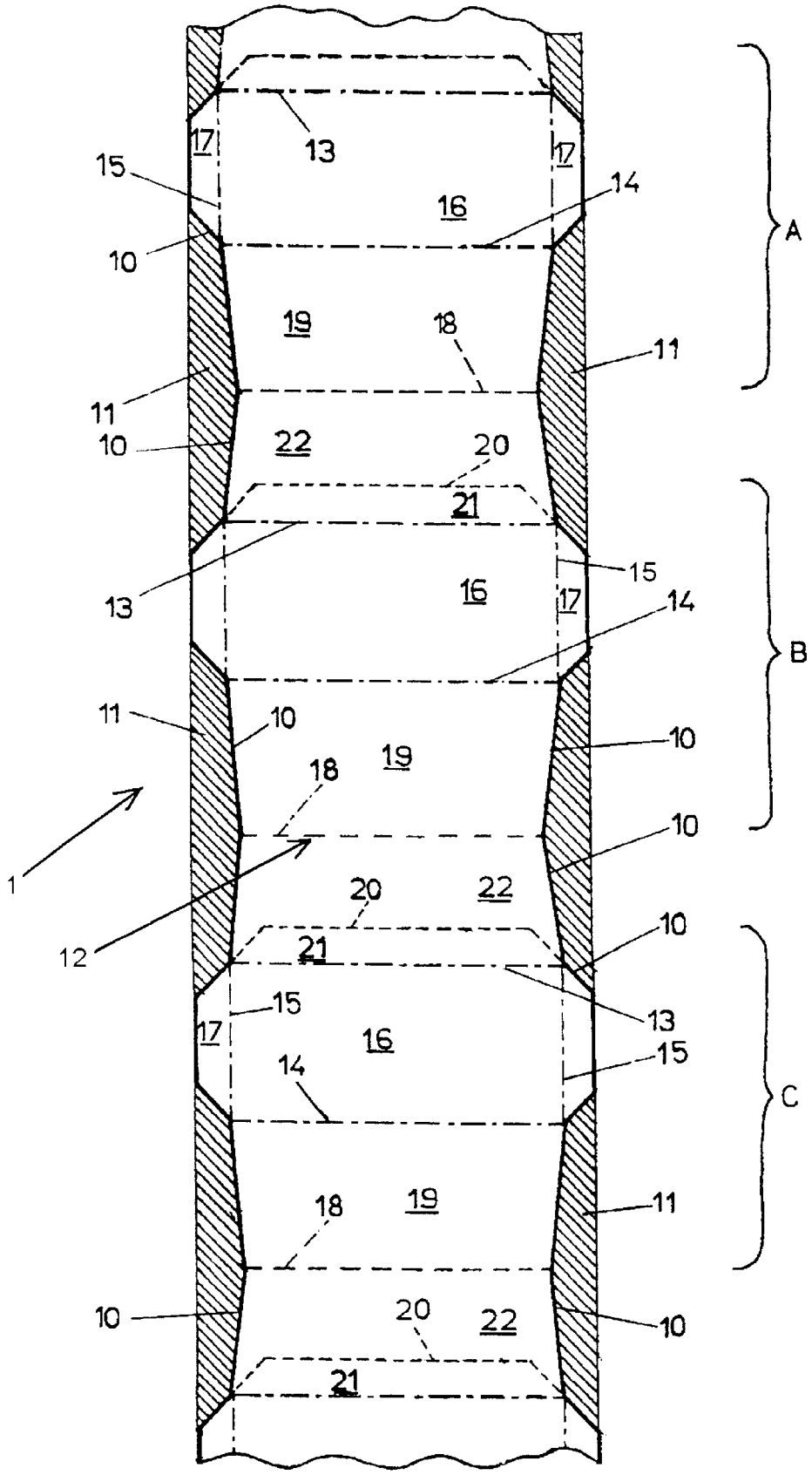
FIG. 1 is a plan view of consecutive series of areas of material.

In order to constitute a strip of consecutive products, in a first application of the invention, a basic form 12 from which envelopes are made, is cut out of a continuous strip of material 1, preferably a strip of paper, cardboard or plastic, as represented in FIG. 1, along the lines 10 in the longitudinal direction of this strip 1. The hatched zones 11 thus are removed from the sides of the strip 1.

Further, the folding lines 13, 14 and 15 as well as the folding division lines 18 are applied to this basic form 12. The folding lines 13 and 14 extend transverse to the length of the strip and right across the width of basic form 12, whereas the folding lines 15 extends along the longitudinal direction of this basic form 12. Folding lines 13, 14 and 15 delineate the front side 16 of an envelope. Folding lines 15 separate side flaps 17 from this front side 16. Back 19 of an envelope is delineated, on the one hand, by a folding division line 18 and a folding line 14, and, on the other hand, by lines 10 or, accordingly, the longitudinal edge of the basic form 12. Next to front side 16 of an envelope, a closing flap 21 has been provided. This closing flap is delineated by a folding line 13 and a division line 20. Thus, a joint pieces 22 is constituted, connecting two consecutive envelopes and is delineated by a division line 20 and the subsequent folding and division line 18.

Consequently, the basic form 12 contains consecutive series of areas of material, each series of those areas being separated by division lines 18, 20. In each series, the areas are constituted by, successively, a back 19, a front side 16 and a closing flap 21, separated by folding lines 13, 14, 15 which permit the folding of an envelope. Two consecutive series are interconnected by the aforementioned joint piece 22. Thus, three series A, B and C are represented in basic form 12 of FIG. 1.

The folding lines 13, 14, 15 are provided to make the folding easier and more accurate in constituting the envelopes. When the envelopes are machine-made, these folding lines may possibly be left out and the folding of the envelopes requires then but one stage. The forming of the envelopes may therefore take place on the basis of a continuous strip of material, both the aforementioned basic form 12 being cut out and the envelopes being folded and glued all at one stage. The basic form represented in FIG. 1 may therefore show an almost unlimited length.

Figure 2:
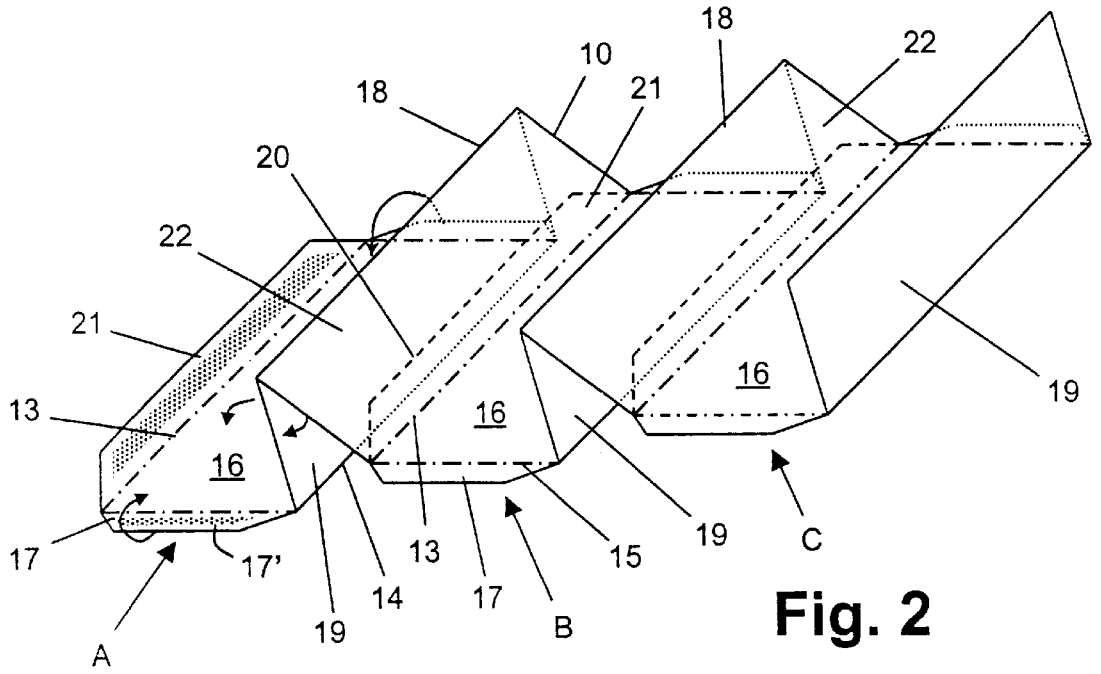
FIG. 2 provides a schematic drawing of how envelopes are formed, according to the invention, from series of areas of material from FIG. 1.

FIG. 2 shows the forming of the envelopes on the basis of a basic form 12 consisting of three series A, B and C of areas of material. Accordingly, a first envelope is made by folding both side flaps 17 against the corresponding front band 16, around folding line 15. Next, an adhesive 17' is applied to the side of those side flaps 17 turned away from the front side 16. The corresponding back 19 is then folded against the side flaps 17, around folding line 14, in order for back 19 to be attached to side flaps 17.

The outside of the in-turned side flaps 17 and the inside of the in-turned back 19 may also be joined in another way, according to the material used. When folding the back 19 along the lines of the method described above, joint piece 22, following back 19, is folded simply around folding and division line 18, in such a way that this joint piece 22 is now at the side of back 19 which is turned away from front side 16 of the envelope. The other series are folded analogously into envelopes.

The closing flap 21 of an envelope formed from the first series of areas of material of a basic form 12 may be closed or not.

Figure 3:
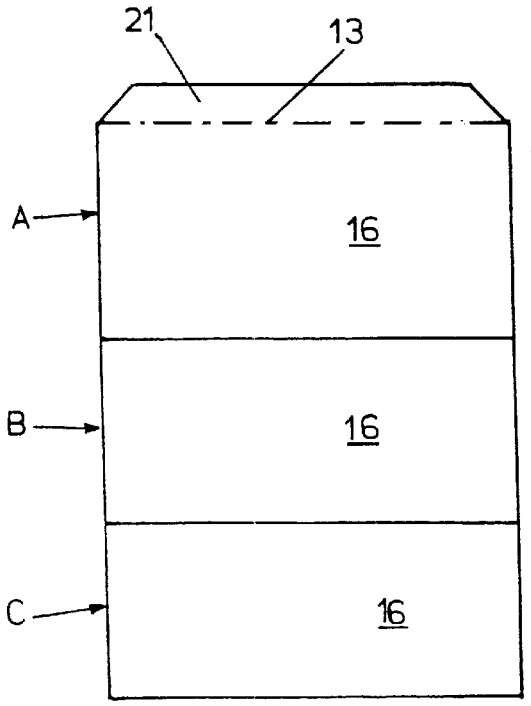
FIG. 3 represents a schematic plan view of a strip with three envelopes according to the invention.
Figure 4:
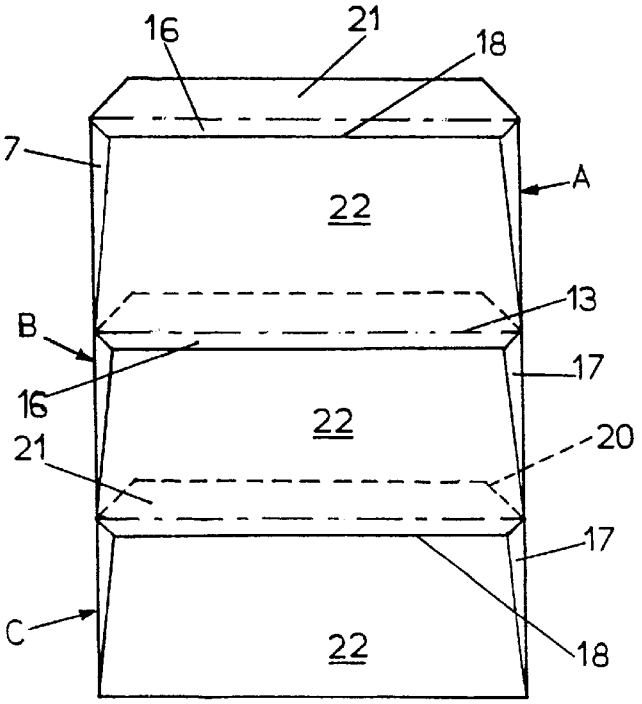
FIG. 4 represents the bottom view of the strip of FIG. 3.

FIG. 3 shows the three front portions 16 of consecutive envelopes A, B and C formed in the above-mentioned manner. FIG. 4 represents the back 19 of the strip of envelopes shown in FIG. 3. In the course of that process, the closing flaps 21 are provided with an adhesive agent 21' allowing to attach the closing flaps 21, after they have been folded around folding line 13, to the corresponding backs 19, in order to close the envelopes.

It is self-evident that basic form 12 for the envelopes may be executed in various types, both for continuous series and for a certain amount of envelopes.

The use of joint pieces 22 is also multifunctional. They may take any form without this affecting the quality of the envelopes. In a special application, for instance, joint pieces 22 in basic form 12 are made sufficiently broad, so that, in a strip of folded envelopes, in addition to the entire closing flaps 21, also part of joint pieces 22 exceeds beyond the front portions 16 of the respective envelopes Thus, these joint pieces 22 may be printed simultaneously with the envelopes. This application is very useful when a counterfoil has to be preserved as a check of the printed envelopes or for filing purposes. In that way, these joint pieces 22 may constitute such a counterfoil which not only exceeds from under the envelopes, but which may for instance also be filed, after having been printed simultaneously with the envelopes.

In a very advantageous application of the strip 1, according to the invention, uninterrupted series of envelopes are constituted, the joint pieces 22 being attached to a common carrier on the folding of the envelopes. This carrier may, for instance, be a paper strip which, on folding the envelopes, is progressively glued to the joints. This application has the advantage that the joint pieces 22 remain fixed to the carrier, when the envelopes are removed. This mainly holds plus-points in filing the joint pieces 22, when the latter constitute the above-mentioned counterfoils. Moreover, the envelopes then may be separated from joints pieces 22 through one single operation, by retaining a number of consecutive envelopes, on the one hand, and the said carrier, on the other hand.

Figure 5:
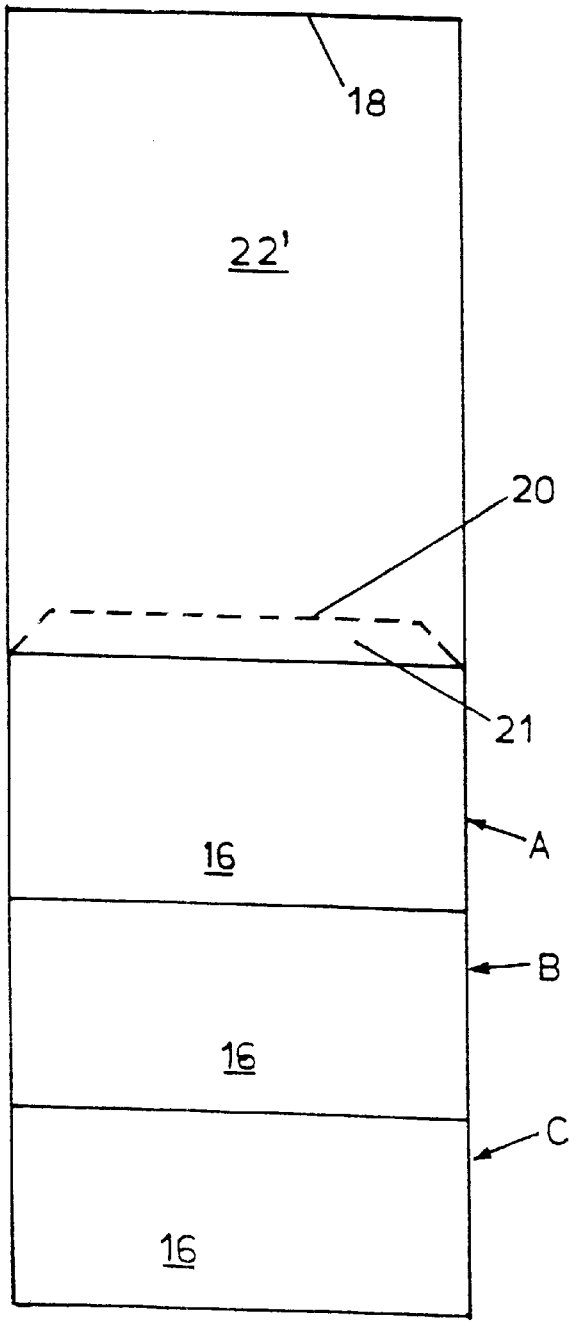
FIG. 5 represents three envelopes, according to the invention on a joint piece carrier.
Figure 7:
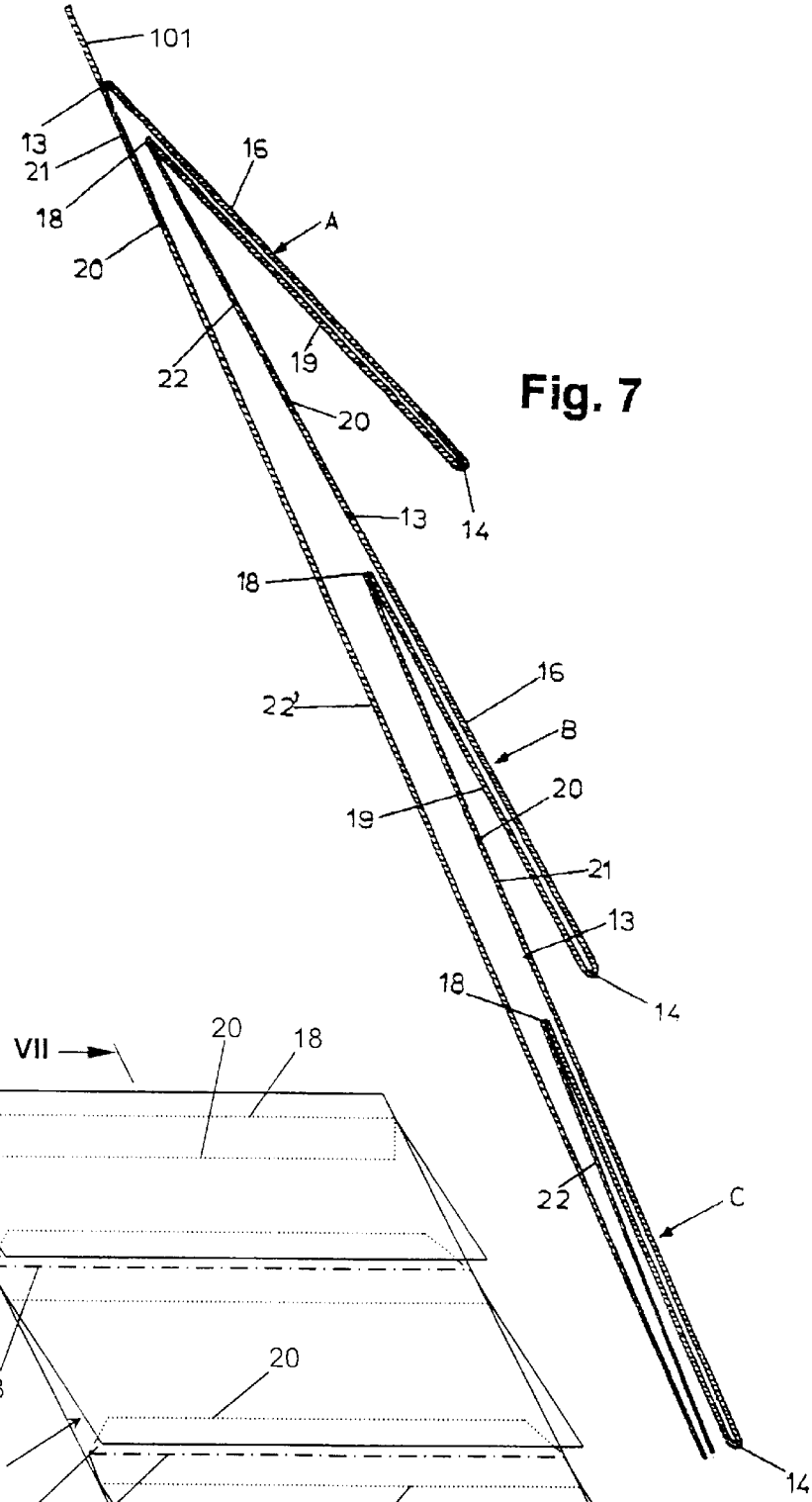
FIG. 7 represents a cross section according to the line VII—VII of FIG. 1.
Figure 6:
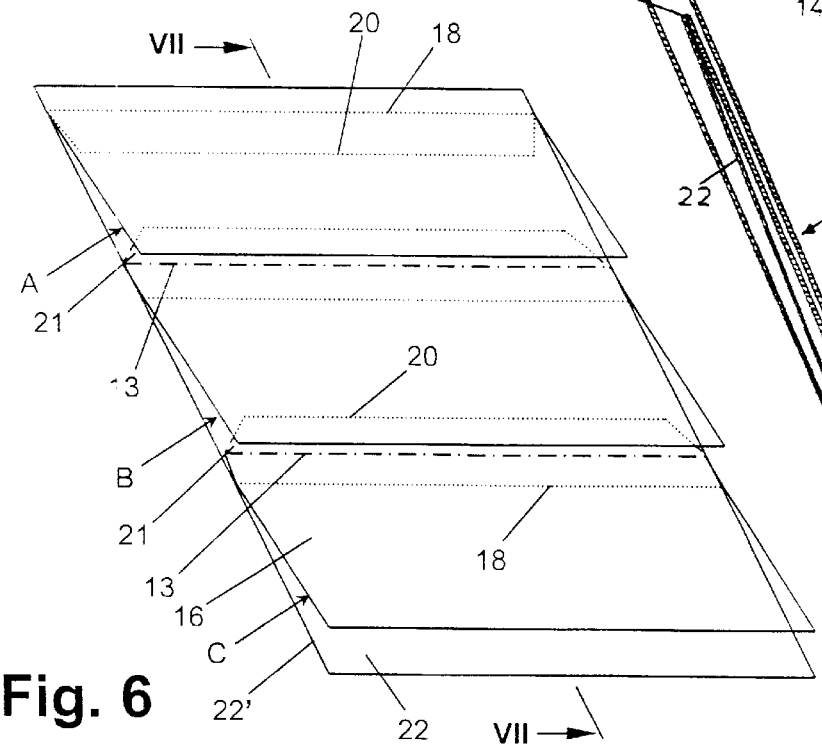
FIG. 6 provides a schematic perspective drawing of a joint piece carrier, according to the invention, with three envelopes.

This application is illustrated in FIGS. 5–8 through a strip of three consecutive envelopes A, B and C. Joint piece carrier 22', preceding envelope A, is lengthened to such an extent that, when closing flap 21 of envelope A is folded back, joint piece carrier 22' covers the whole back of the three envelopes A, B and C. This joint piece carrier 22' constitutes the said carrier discussed above and, thus, is attached to the other joint pieces 22 which link up at the back 19 of envelopes A, B and C. In FIG. 5, this joint piece carrier 22' is represented in a non-folded back position, together with the folded envelopes A, B and C. In FIG. 6, this application is drawn schematically in perspective, joint piece carrier 22', corresponding to envelope A, being folded back to meet the other joints piece 22 of envelopes A, B and C. Further, joint 22, following envelope C, is about as broad as back 19 of this envelope C, in order for it to overlie this back after folding. FIG. 7 represents a cross-section of FIG. 6.

If joint pieces 22 are glued to joint piece carrier 22', as set out above, a unit, called envelope sheet, is formed. Subject to the dimensions and shape of the said basic form 12, this envelope sheet may assume all possible sizes. Thus, when indeed the appropriate dimensions are being applied, the envelope sheet may be given a DIN A4 format, which may be printed by every standard printer. Those envelope sheets may be put per batch in the printer; they will automatically be picked up one by one and printed. This makes it possible to handle whole series of envelopes in an ordinary standard printer without any further investment being required. For a printer with a very sensible lifting mechanism, a strip of paper 101 as shown in FIG. 7 is applied to the closing flap of the first envelope by non-permanent glue. Preferably, strip 101 should exceed the sheet by about 1 to 1.5 cm. It would be more appropriate to glue strip 101 to the beginning of joint piece 22'.

When, on basic form 12, division lines 20 and folding and division lines 18 hold but at a few places, i.e., when, for instance, they have been well perforated two or three times for a distance of 1 cm, or are thus provided with a division strip, while the rest of those lines have been cut loose, this permits a great advantage in that the envelopes may be removed from the whole at one pull. Each one of the loose envelopes is fully finished.

Figure 8:
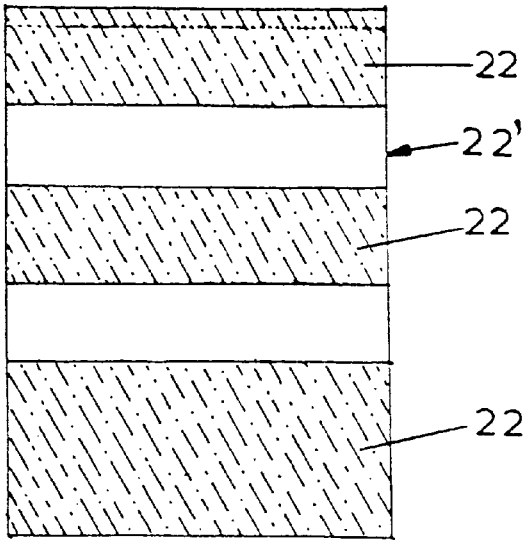
FIG. 8 schematically represents severed joint pieces.

The severing of the envelopes should be done as follows: the envelopes, the bases of which are held together are taken firmly into one hand, while with the other hand the joint piece carrier is gripped; then a short but fierce tug should be given. The envelopes then will be held in one hand, whereas all joint pieces 22 will be left in the other. FIG. 8 represents the removed joint pieces 22, the joint 22' being shown cross hatched. Joint piece carrier 22' here constitutes a single page provided with the remaining joint pieces 22. Those joints 22 may be filed, since, during printing, an identical reference as on the corresponding envelope may be applied to joint 22. Anyway, on single page joint piece carrier 22', the joint pieces are glued in the right order of printing of the envelopes.

The envelope sheet, which has been described above, is made of the same kind of paper, since it is formed from a continuous strip of paper, and therefore may be relatively heavy. In order to make it lighter, joint piece carrier 22' can be reduced to a strip of about 1 cm as from the end of the closing flap 21 of the first envelope. A much lighter type of paper, for instance onionskin, may be glued to that bit, in order to return joint piece carrier 22' to its size as described above and to handle it further in the above-mentioned way.

Figure 9:
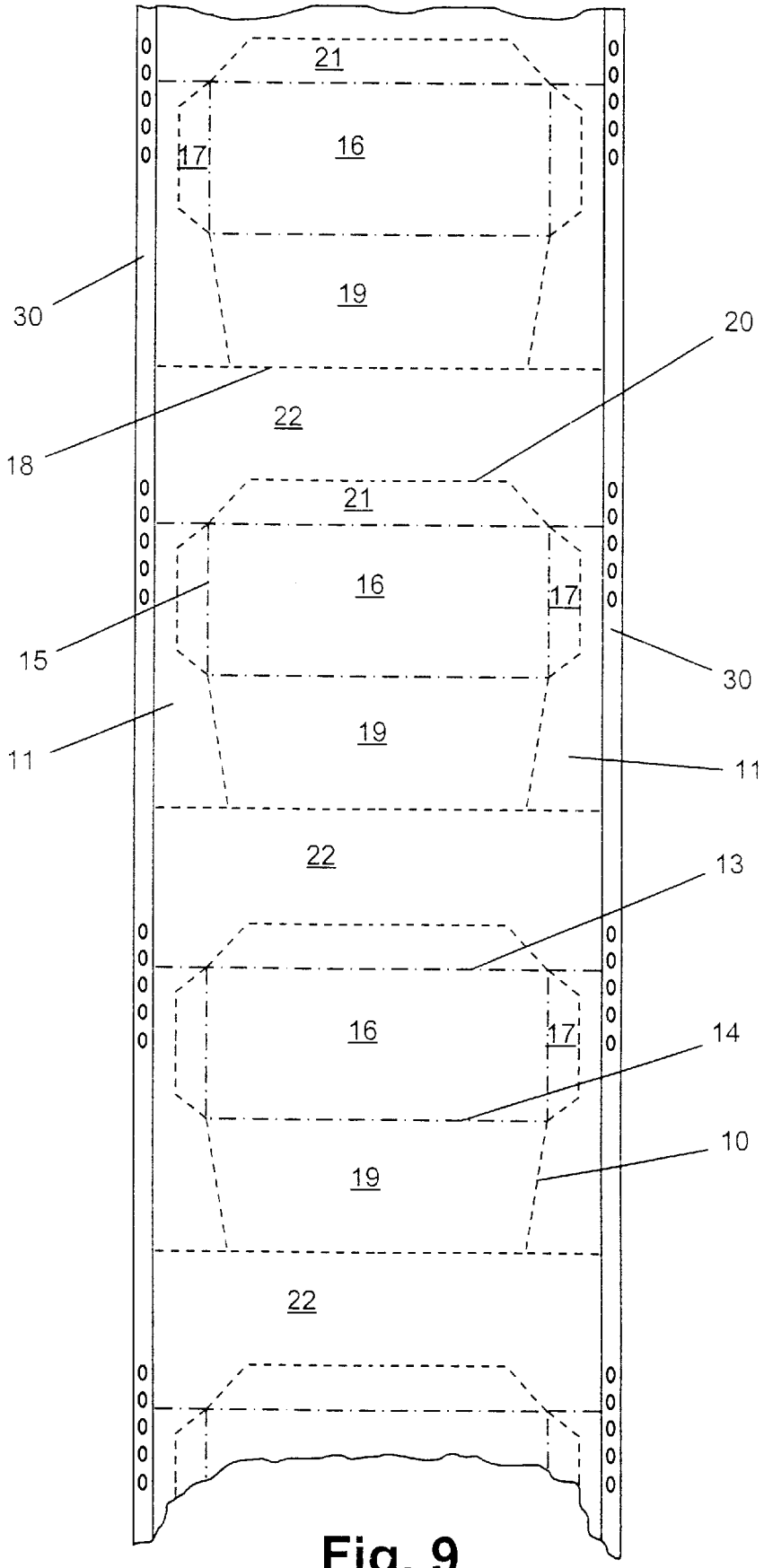
FIG. 9 provides a schematic plan view of consecutive series of areas of material provided with bands for pin-type feeding.

FIG. 9 is a plan view of an adjusted basic form of envelopes for pin-type feeding. The hatched area in the drawing represents the severed material. Apart from that, the process to attain the finished product is identical to the method described above.

The folding and division lines on the non-cut side bands 30 are also applied, so that they are folded up in the course of the actual forming of the envelopes.

In finishing this variant, an adhesive agent may be applied, on folding, to the places where the side bands 30 overlap or they may be connected in any other way. It would be proper to apply the perforations which must be provided for pin-type feeding devices, after the forming has been completed.

It is important that those side bands or transport bands 30 are only attached sideways to joint pieces 22, so that, when removing those bands 30, no traces of perforated lines are left on the sides of the envelopes.

Figure 10:
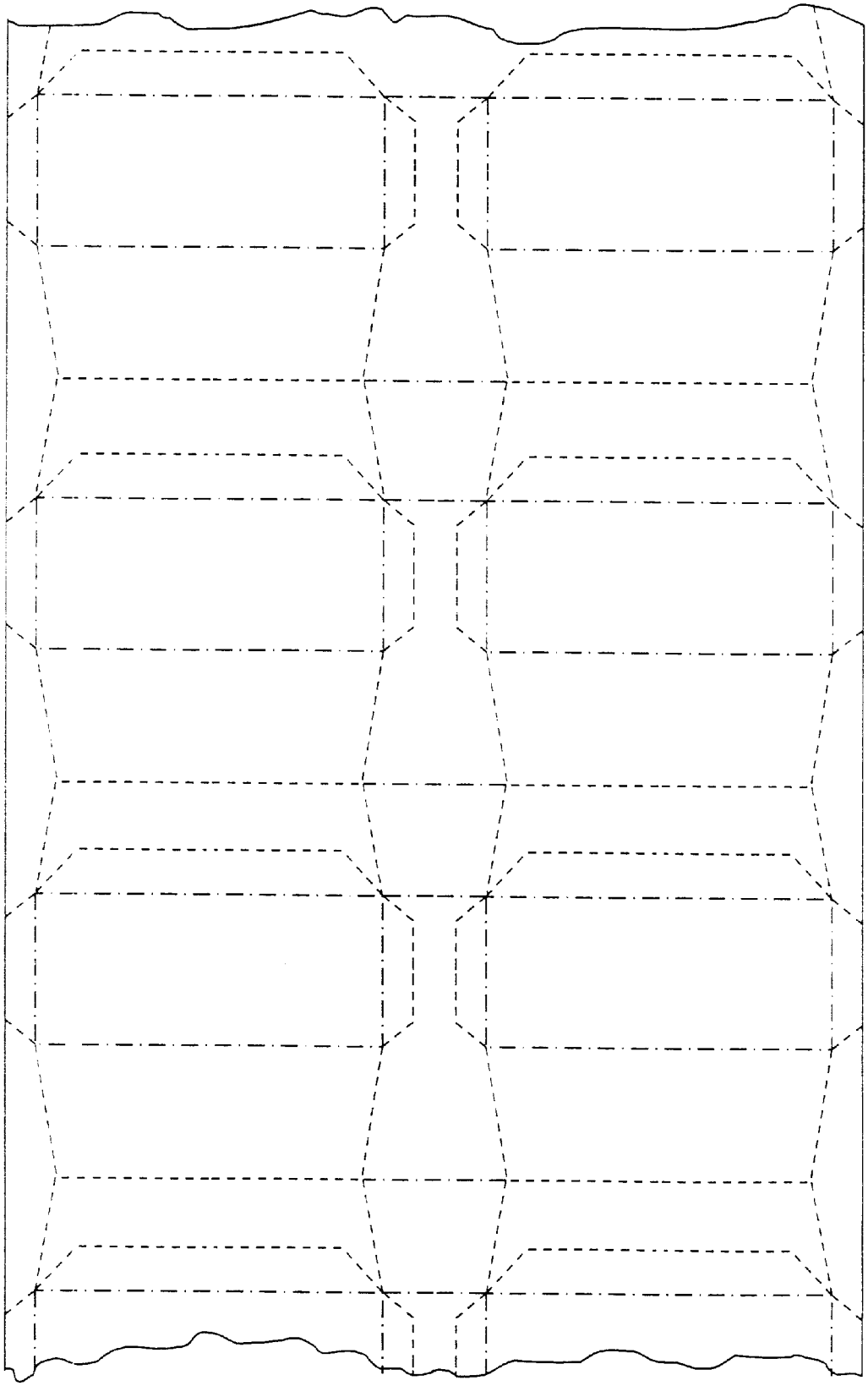
FIG. 10 represents a plan view of two parallel series of areas of material.

FIG. 10 shows a basic form 12 in which the envelopes are also put horizontally next to each other, so that, at the constitution according to the process as described above, two envelopes are being shaped simultaneously. Per horizontal series, two in this drawing, it should be made sure that the side flaps 17 of each envelope are simultaneously folded inward and provided with adhesive agent 17' or a subsitute adhesive. The procedure of FIG. 9 (pin-type feeding system) may or may not be applied to it. Possibly, more than two series of areas of material next to each other may be provided in one basic form 12.

When the strip of envelopes, according to the invention, is applied to printers using the standard DIN A4 format, irrespective of whether the paper input takes place through a paper tray, through a cutsheet feeder or page by page, the strip of paper (material) must be cut up (shaped) in pieces having a previously set length. The paper (material) treated according to the invention, thus, as a finished product, provides several envelopes the number of which differs according to the desired envelope format. More in particular, a format of a DIN A4 sheet, after the folding and shaping of basic form 12, is being attained which may be applied to every printer using DIN A4 format, if the basic form is given the proper dimensions. In view of the stepped production process, the format of the envelope and therefore the number of envelopes per individually finished envelope sheet, with already formed envelopes, may be adjusted by reducing or enlarging the joint piece 22.

An envelope which is severed from the sheet and which is closed (or is removed from the formed material), in spite of the production process according to which the envelopes (products) remain interconnected until the end use, is characterised by outlines which are intact and show no division marks whatsoever. Briefly, the end product is a fully completed envelope.

As has been shown above, the strip, according to the invention, differs in many ways from the technical state of affairs of the patents U.S. Pat. No. 4,066,206 (PETERSON), FR-A-1 488 888 (GYSIN) and GB-A-567 924 (DAVIES).

The first two of those patents do indeed pertain to a continuous strip of envelopes, but the envelopes are put together as loose finished units, in view of constituting that strip. The envelopes of that strip, therefore, are not being formed from a continuous strip of paper.

In a first application of patent GB-A-567924, a strip of envelopes is being constituted out of a continuous strip of paper.

It should be pointed out that the said first application of this patent will still show division lines or cutting marks on the edges of the front side of the formed envelopes. Those lines result from removing the transport bands on severing the envelopes from the series. Even if those bands are at the sides of the back of the envelopes or at the sides of the closing flaps, the same problem will still arise.

Another drawback is the fact that those envelopes can only be severed one by one. No trace is left of the severed envelope, which may be used as a voucher to be filed. The continuous strip can only be applied to machines which are equipped with pin-type feeding.

The requirement to apply the labels later on, one by one, to the envelopes still is a time-consuming and little effective process. In addition, automatic envelope machines still not only have trouble in coping with labelled envelopes, but also with window envelopes, which did provide a solution through skipping the stage of the separate addressing of the envelopes. Using labels or window envelopes then generally results in putting the items to be sent or to be distributed in the envelope by hand. The invention provides a solution to the above-mentioned problem. The end user can also print series of envelopes through his own printer, without this entailing any extra hardware expenses. He also still has a filing voucher per envelope, which holds an identification system. In some applications, still more extra information may be printed on this filing voucher. The invention also eliminates the sideways division lines at the front or the back of the envelopes, which were still apparent at envelopes that also were formed from a continuous strip of paper, while still being interconnected.

The technical problem the invention solves, is that the separate envelope may be formed from a continuous strip of paper and remains interconnected, while, in spite of that characteristic, it is being made fully ready for use and finished without there being any division lines or cutting marks on the edges of any part of the envelope. This is possible through leaving the chosen basic forms of the envelopes interconnected by means of a joint piece which, even after the forming of the finished product, is preserved as a joint piece.

I claim:

1. Detachable products obtained by folding a single continuous strip of material along folding lines, wherein each of said products is respectively interconnected through a joint piece (22) formed by a section of said strip, said joint piece not being part of the products and detachably linked between each of two consecutive products of said products by perforated and folding lines, so that on removing each said joint piece (22), said products are entirely separated, wherein each of said products is formed from consecutive areas of material in a longitudinal direction, each of said consecutive areas having at least one folding line transverse to said longitudinal direction, said joint piece detachably linked between each of two said consecutive areas at a free edge parallel to said folding line of a first of said two consecutive areas and to an initial area of a second of said two consecutive areas, and wherein each of said consecutive areas of material form a closing flap, a front and a back of an envelope, and wherein said initial area is said closing flap, and said end is said back.

2. The detachable products according to claim 1, wherein at least part of each said joint piece is attached to a common carrier so that the joint piece (22), together with the common carrier, may be severed from the products in one single operation.

3. The detachable products according to claim 1, wherein each said joint piece (22) extends under the products so that said joint piece can be printed in an identical manner to and simultaneously with, the products interconnected by said joint piece.

4. The detachable products according to claim 1, wherein each side of said strip is provided with a transport band with successive perforations, said transport band being made from the same material as said consecutive areas, and wherein said transport bands (30) are only engaged to sides of each said joint piece, so that sides of said consecutive areas of material are spaced apart from said transport bands (30).

* * * * *